US009928800B2

(12) United States Patent
Kim et al.

(10) Patent No.: US 9,928,800 B2
(45) Date of Patent: Mar. 27, 2018

(54) DISPLAY APPARATUS AND A METHOD OF DRIVING THE SAME

(71) Applicant: SAMSUNG DISPLAY CO., LTD., Yongin-si, Gyeonggi-Do (KR)

(72) Inventors: Jong-Woon Kim, Cheonan-si (KR); Ja-Hun Koo, Asan-si (KR); Kyu-Jin Park, Cheonan-si (KR); Su-Han Woo, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/145,066

(22) Filed: May 3, 2016

(65) Prior Publication Data

US 2017/0047037 A1 Feb. 16, 2017

(30) Foreign Application Priority Data

Aug. 13, 2015 (KR) ..... 10-2015-0114885

(51) Int. Cl.
*G09G 3/36* (2006.01)

(52) U.S. Cl.
CPC ..... *G09G 3/3696* (2013.01); *G09G 3/3607* (2013.01); *G09G 3/3677* (2013.01); *G09G 3/3688* (2013.01); *G09G 2300/0469* (2013.01); *G09G 2300/08* (2013.01); *G09G 2310/0289* (2013.01); *G09G 2310/0291* (2013.01); *G09G 2310/08* (2013.01)

(58) Field of Classification Search
CPC ... G09G 2320/0257; G09G 2320/0247; G09G 3/3696; G09G 3/3607
See application file for complete search history.

(56) References Cited

U.S. PATENT DOCUMENTS

2002/0041281 A1* 4/2002 Yanagi ..... G09G 3/3648 345/212
2005/0200588 A1* 9/2005 Kaneda ..... G09G 3/3655 345/98
2011/0102401 A1* 5/2011 Feng ..... G09G 3/3655 345/211
2012/0320019 A1* 12/2012 Jeong ..... G09G 3/2096 345/211
2017/0031428 A1* 2/2017 Small ..... G06F 3/044

FOREIGN PATENT DOCUMENTS

KR 1020120139451 12/2012
KR 1020150011910 2/2015

* cited by examiner

*Primary Examiner* — Lixi C Simpson
(74) *Attorney, Agent, or Firm* — F. Chau & Associates, LLC

(57) ABSTRACT

A display apparatus includes a display panel. The display panel includes a high sub-pixel, a low sub-pixel and a toggle voltage input circuit. The high sub-pixel may include a first switching element connected to a gate line extending in a first direction and a data line extending in a second direction crossing with the first direction. The low sub-pixel may include a second switching element connected to the gate line and the data line and disposed opposite to the high sub-pixel with reference to the gate line, and a third switching element connected to the second switching element and a storage line. The toggle voltage input circuit may be connected to the storage line to transmit a toggle voltage to the low sub-pixel. The toggle voltage may be capable of being varied periodically.

17 Claims, 5 Drawing Sheets

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2015-0114885, filed on Aug. 13, 2015 in the Korean Intellectual Property Office (KIPO), the disclosure of which is incorporated by reference herein in its entirety.

TECHNICAL FIELD

Exemplary embodiments of the present inventive concept relate to a display apparatus and a method of driving the display apparatus.

DISCUSSION OF RELATED ART

A display device, such as a liquid crystal ("LCD") display or an organic light emitting diode ("OLED") display, generally includes a display panel including a plurality of pixels, a switching element, a plurality of signal lines, a voltage generator and a data driver. The voltage generator generates a reference voltage. The data driver generates a plurality of voltages using the reference voltage and applies the voltage corresponding to an input image signal, as a data signal to a data line.

The LCD typically includes two panels having pixel electrodes on an upper panel, opposing electrodes on a lower panel, and a liquid crystal layer having dielectric anisotropy interposed between the upper and lower panels. The pixel electrodes are arranged in a matrix form and are connected to switching elements, such as a thin film transistor ("TFT"), to sequentially receive the data voltage row by row. The opposing electrodes are disposed at the surface of the lower panel and receive a common voltage. Voltages are applied to the pixel electrode and the opposing electrode to generate an electric field in the liquid crystal layer. The intensity of the electric field controls the transmittance of light passing through the liquid crystal layer, thereby generating an image.

In a vertical alignment type LCD apparatus, a unit pixel of a display panel includes a high pixel and a low pixel. A data voltage is applied to the high pixel and a data voltage decreased by a storage voltage is applied to the low pixel.

SUMMARY

According to an exemplary embodiment of the present invention, a display apparatus includes a display panel. The display panel includes a first sub-pixel, a second sub-pixel and a toggle voltage input circuit. The first sub-pixel including a first switching element connected to a gate line extending in a first direction and a data line extending in a second direction crossing with the first direction. The second sub-pixel including a second switching element connected to the gate line and the data line, and a third switching element connected to the second switching element and a storage line. The toggle voltage input circuit connected to the storage line to apply a toggle voltage to the second sub-pixel. A level of the toggle voltage varies periodically.

In an exemplary embodiment of the present invention, the toggle voltage may be more than 6.5V and less than 9.5V.

In an exemplary embodiment of the present invention, the toggle voltage input circuit may include a toggle signal input circuit configured to output a toggle signal. A direct current (DC) voltage input circuit configured to output a DC voltage and the DC voltage input circuit may be connected to the toggle signal input circuit. An amplifier configured to output the toggle voltage by amplifying a voltage based on the toggle signal and the DC voltage.

In an exemplary embodiment of the present invention, the toggle signal input circuit may include a transistor. The toggle signal may be more than 3.0V and less than 3.5V.

In an exemplary embodiment of the present invention, the DC voltage input circuit may include a diode. The DC voltage may be voltage of 6.5V.

In an exemplary embodiment, the amplifier may include an operational amplifier.

In an exemplary embodiment of the present invention, the first sub-pixel may include a first pixel electrode and a first voltage may be applied to the first pixel electrode. The second sub-pixel may include a second pixel electrode, and a second voltage less than the first voltage may be applied to the second pixel electrode.

In an exemplary embodiment of the present invention, a voltage applied to the second sub-pixel may be distributed to the second switching element and the third switching element.

In an exemplary embodiment of the present invention, the display apparatus may further include a data driver connected to the data line to apply a data voltage to the display panel.

In an exemplary embodiment of the present invention, the display apparatus may further include a gate driver connected to the gate line to apply a gate voltage to the display panel.

According to an exemplary embodiment of the present invention, a method of driving a display panel includes inputting a toggle signal to an amplifier, inputting a direct current (DC) voltage to the amplifier and outputting a toggle voltage from the amplifier, wherein the toggle voltage is based on the toggle signal and the DC voltage, and the toggle voltage is periodically varied. The display panel includes a first sub-pixel comprising a first switching element connected to a gate line extending in a first direction and a data line extending in a second direction crossing with the first direction. The display panel also includes a second sub-pixel comprising a second switching element connected to the gate line and the data line, and a third switching element connected to the second switching element and a storage line.

In an exemplary embodiment of the present invention, the toggle voltage may be more than 6.5V and less than 9.5V.

In an exemplary embodiment, the amplifier may be included in a toggle voltage input circuit. The toggle voltage input circuit may include a toggle signal input circuit configured to generate the toggle signal. A DC voltage input circuit may generate the DC voltage.

In an exemplary embodiment of the present invention, the toggle signal input circuit may include a transistor. The toggle signal may output a voltage of more than 3.0V and less than 3.5V.

In an exemplary embodiment of the present invention, the DC voltage input circuit may include a diode. The DC voltage may output a voltage of 6.5V.

In an exemplary embodiment of the present invention, the amplifier may include an operational amplifier.

In an exemplary embodiment of the present invention, the first sub-pixel may include a first pixel electrode that is applied with a first voltage. The second sub-pixel may include a second pixel electrode that is applied with a second voltage. The second voltage may be less than the first voltage.

In an exemplary embodiment of the present invention, a voltage applied to the second sub-pixel may be distributed to the second switching element and the third switching element.

In an exemplary embodiment of the present invention, the display panel may be connected to a data driver. The data driver may be connected to the data line to apply a data voltage to the display panel.

In an exemplary embodiment of the present invention, the display panel may be connected to a gate driver. The gate driver may be connected to the gate line to apply a gate voltage to the display panel.

According to an exemplary embodiment of the present invention, a method of driving a display panel may include applying a data voltage to a first and second sub-pixel electrode when a gate-on voltage is applied to a gate line and applying a first toggle voltage to a first storage electrode. The method may further include reducing the data voltage applied to the second sub-pixel electrode by transferring a first portion of the data voltage at the second sub-pixel electrode through a first auxiliary switching element to the first storage electrode when the gate-on voltage is applied to the gate line. The first toggle voltage may be lower than the data voltage. The first storage electrode may be connected to an output of the first auxiliary switching element.

In an exemplary embodiment of the present invention, the method may include outputting a toggle signal by a toggle signal input circuit to amplifier, outputting a direct current (DC) voltage by a DC voltage input circuit to an amplifier and outputting a toggle voltage by the amplifier based on the toggle signal and the DC voltage. The DC voltage input circuit may be connected to the toggle signal input circuit.

In an exemplary embodiment of the present invention, the method may include applying a second toggle voltage to a second storage electrode. The method may further include increasing the data voltage applied to the first sub-pixel electrode by transferring a second portion of the second toggle voltage to the first sub-pixel electrode through a second auxiliary switching element to the second storage electrode when the gate-on voltage is applied to the gate line. The second toggle voltage may be higher than the data voltage and the second storage electrode may be connected to an output of the second auxiliary switching element.

BRIEF DESCRIPTION OF THE DRAWINGS

The above and other features of the present inventive concept will become more apparent by describing exemplary embodiments thereof with reference to the accompanying drawings, in which.

DETAILED DESCRIPTION OF THE EMBODIMENTS

Exemplary embodiments of the present inventive concept will be explained hereinafter with reference to the accompanying drawings.

Figure 1:
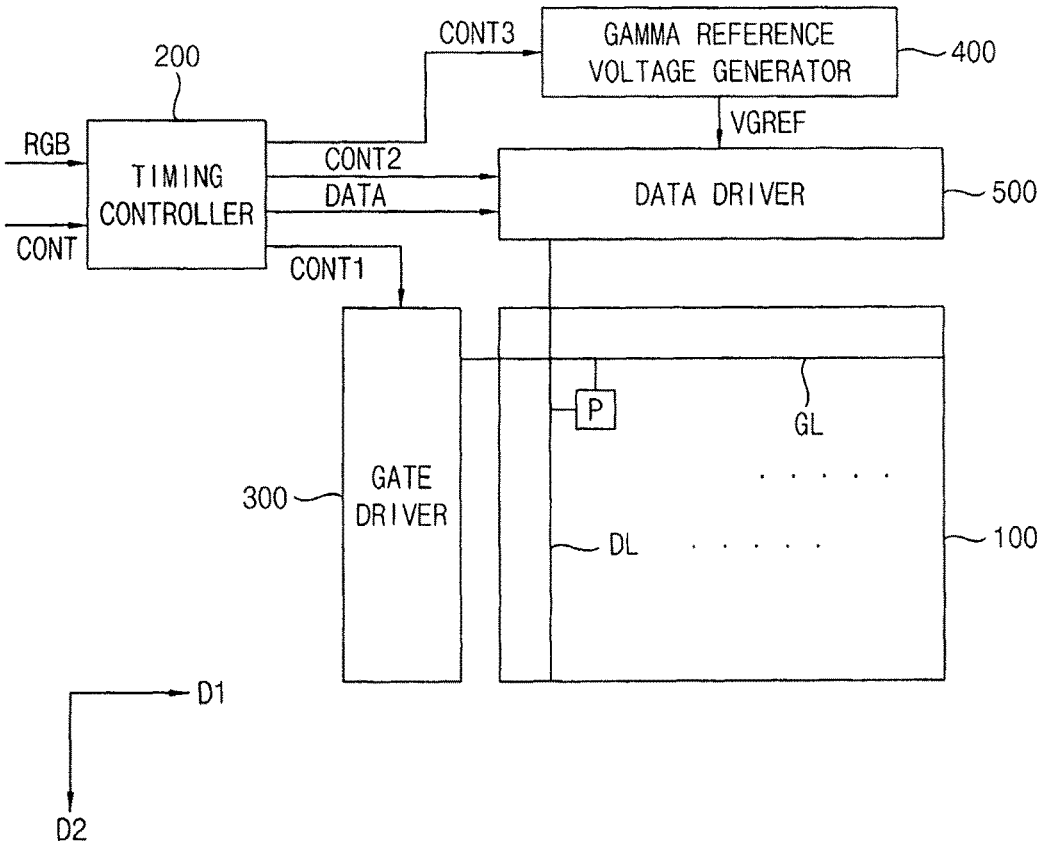
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 displays an image based on input image data. The display panel 100 has a display region on which the image is displayed and a peripheral region adjacent to the display region.

The display panel 100 includes a plurality of gate lines GL, a plurality of data lines DL and a plurality of sub-pixels P connected to the gate lines GL and the data lines DL. The gate lines GL extend in a first direction D1 and the data lines DL extend in a second direction D2 crossing the first direction D1. The second direction D2 may be substantially perpendicular to D1.

Each sub-pixel P includes a switching element SW and a capacitor electrically connected to the switching element SW. The sub-pixels P may be arranged in a matrix form. For example, the switching element SW may be a thin film transistor.

For example, the display apparatus may be a liquid crystal display (LCD) apparatus or an organic light emitting diode (OLED) display apparatus. An exemplary embodiment of the present inventive concept may be applied to various display apparatuses which include a thin film transistor.

The timing controller 200 receives the input image data RGB and an input control signal CONT from an external apparatus. The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates a data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be integrated on the peripheral portion of the display panel 100. In an exemplary embodiment of the present inventive concept, the gate driver 300 may be directly mounted on the display panel 100, or may be connected to the display panel 100 in a tape carrier package (TCP).

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment of the present inventive concept, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

The data driver 500 may be directly mounted on the display panel 100, or be connected to the display panel 100 in a TCP. The data driver 500 may be integrated on the display panel 100.

Figure 2:
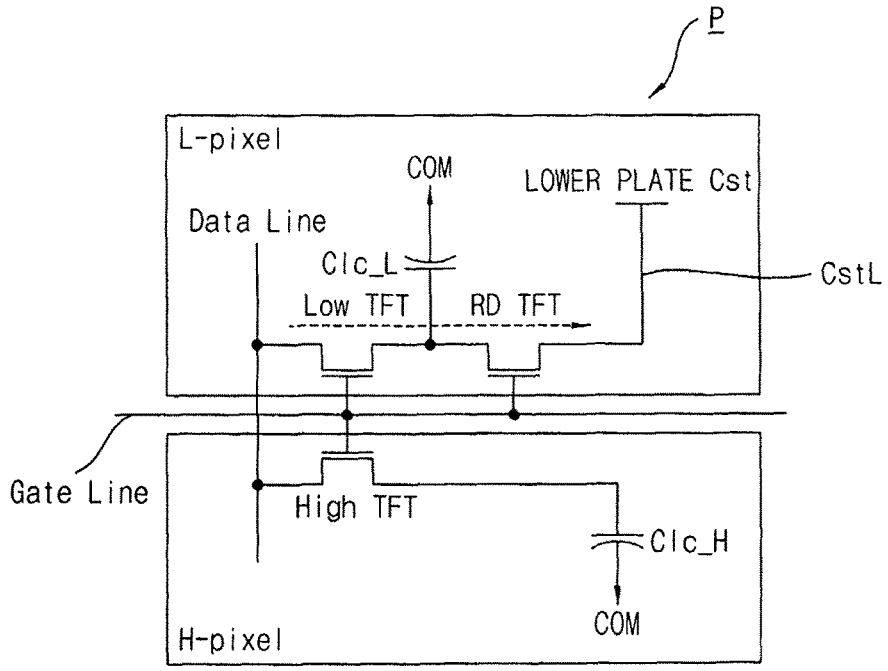
FIG. 2 is a circuit diagram illustrating a pixel structure of the display apparatus of FIG. 1.
Figure 3:
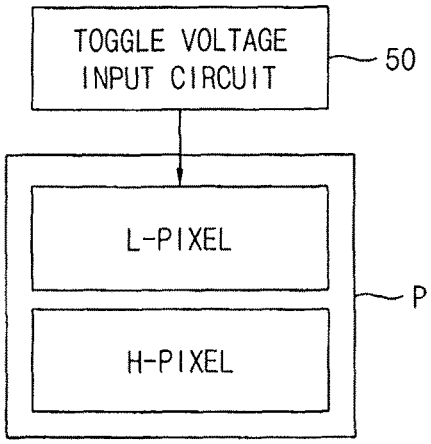
FIG. 3 is a block diagram illustrating a pixel of a display apparatus according to an exemplary embodiment of the present inventive concept.

FIG. 2 is a circuit diagram illustrating a pixel structure of the display apparatus of FIG. 1. FIG. 3 is a block diagram illustrating a pixel of a display apparatus according to an exemplary embodiment of the present inventive concept.

Referring to FIGS. 2 and 3, one pixel includes two sub-pixels (a high sub-pixel H-pixel and a low sub-pixel L-pixel).

Two sub-pixels H-pixel and L-pixel respectively include switching elements High thin film transistor (TFT) and Low TFT connected to the same data line and gate line. Control terminals of the switching elements High TFT and Low TFT are connected to the same gate line, and input terminals of the switching elements High TFT and Low TFT are connected to the same data line.

An output terminal of the high switching element High TFT is connected to a high sub-pixel electrode, and an output terminal of the low switching element Low TFT is connected to a low sub-pixel electrode. The high sub-pixel electrode and the low sub-pixel electrode respectively form a high liquid crystal capacitor Clc_H and a low liquid crystal capacitor Clc_L together with an upper common electrode COM disposed on the upper plate.

The low sub-pixel L-pixel further includes an auxiliary switching element RD TFT. The auxiliary switching element RD TFT may be a resistance dividing switching element.

A control terminal of the auxiliary switching element RD TFT is connected to the same gate line as the switching elements High TFT and Low TFT, and an input terminal of the auxiliary switching element RD TFT is connected to the output terminal of the low switching element Low TFT. In a further example, the input terminal of the auxiliary switching element RD TFT is connected to the low sub-pixel electrode. An output terminal of the auxiliary switching element RD TFT is connected with a storage electrode denoted by 'lower plate Cst'. The storage electrode (e.g. lower plate Cst) is connected through a storage electrode line (e.g. CstL), and storage voltage Vcst is applied to the storage electrode. The storage voltage Vcst may have a lower voltage than the data voltage.

In an exemplary embodiment of the present inventive concept, the input terminal of the auxiliary switching element RD TFT may be connected with the storage electrode and the output terminal of the auxiliary switching element RD TFT may be connected to the output terminal of the low switching element Low TFT. The terminals of the auxiliary switching element RD TFT may also be reversed. For example, the output terminal of the auxiliary switching element RD TFT may be connected with the storage electrode and the input terminal of the auxiliary switching element RD TFT is connected to the output terminal of the low switching element Low TFT.

When a gate-on signal is applied to the gate line, a data voltage is transferred to each sub-pixel electrode through the switching elements High TFT and Low TFT. In the high sub-pixel H-pixel, the data voltage is entirely transferred to the high sub-pixel electrode. However, in the low sub-pixel L-pixel, a voltage lower than the data voltage of the high sub-pixel H-pixel is transferred to the low sub-pixel due to the auxiliary switching element RD TFT. For example, when the gate-on voltage is applied to the gate line, the data voltage is transferred to the output terminal through a channel of the low switching element Low TFT. A portion of the voltage transferred to the output terminal of the low switching element Low TFT is transferred to the low sub-pixel electrode. The remainder of the voltage transferred to the output terminal of the low switching element Low TFT is discharged to the storage electrode (lower plate Cst) through the auxiliary switching element RD TFT.

As such, the data voltage transferred to the low sub-pixel electrode varies depending on a resistance of the auxiliary switching element RD TFT and the storage voltage Vcst applied to the storage electrode (lower plate Cst). In the low sub-pixel structure, the resistance of the auxiliary switching element RD TFT may not change because the resistance is fixed when the pixel is manufactured. However, since the voltage applied to the storage electrode (lower plate Cst), e.g., the storage voltage Vcst, can be changed, the data voltage transferred to the low sub-pixel electrode can be controlled by changing the storage voltage Vcst.

A display apparatus according to an exemplary embodiment of the present inventive concept includes a toggle voltage input circuit 50 connected to the storage line CstL to apply a toggle voltage capable of being varied periodically to the low sub-pixel L-pixel. The toggle voltage input circuit 50 may apply a toggle voltage to the low sub-pixel L-pixel. The toggle voltage may be more than 6.5V and less than 9.5V.

In an exemplary embodiment of the present inventive concept, a second auxiliary switching element output may be connected to a high sub-pixel electrode and a second auxiliary switching element input may be connected to a second storage electrode. A second storage voltage is applied to the second storage electrode. When the gate-on voltage is applied to the gate line, an additional voltage is transferred from the second storage electrode through the second auxiliary switching element to the high sub-pixel electrode.

The toggle voltage input circuit 50 is hereinafter described with respect to FIGS. 4 and 5.

Figure 4:
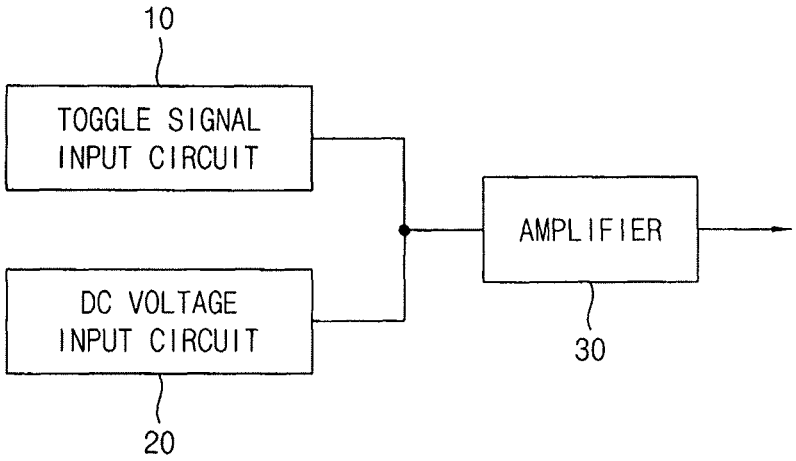
FIG. 4 is a block diagram illustrating a toggle voltage input circuit of a display apparatus according to an exemplary embodiment of the present inventive concept.

FIG. 4 is a block diagram illustrating a toggle voltage input circuit of a display apparatus according to an exemplary embodiment of the present inventive concept. FIG. 5 is a circuit diagram illustrating a toggle voltage input circuit of the display apparatus according to an exemplary embodiment of the present inventive concept.

Figure 5:
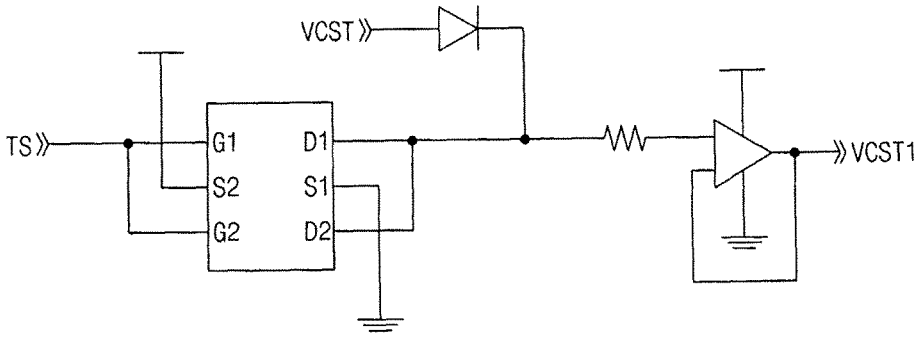
FIG. 5 is a circuit diagram illustrating a toggle voltage input circuit of the display apparatus according to an exemplary embodiment of the present inventive concept.

Referring to FIGS. 4 and 5, a toggle voltage input circuit according to an exemplary embodiment of the present inventive concept includes a toggle signal input circuit 10, a DC voltage input circuit 20 and an amplifier 30.

The amplifier 30 receives a toggle signal TS from the toggle signal input circuit 10. The toggle signal TS may have a voltage of more than 3.0V and less than 3.5V. For example, the toggle signal TS may have a voltage of 3.3V.

The DC voltage input circuit 20 inputs a direct current (DC) voltage VCST to the amplifier 30. The DC voltage input circuit 20 includes a diode. For example, the DC voltage input circuit 20 may input DC voltage VCST of 6.5V to the amplifier 30.

The toggle signal TS from the toggle signal input circuit 10 and the DC voltage VCST from the DC voltage input circuit 20 are input to the amplifier 30. The amplifier 30 amplifies the toggle signal TS and the DC voltage VCST to output a toggle voltage VCST1.

The amplifier 30 includes an operational amplifier. The operational amplifier buffers and compensates the toggle signal TS and the DC voltage VCST to output a toggle voltage VCST1. The operational amplifier includes an inversion input terminal (−), a non-inversion input terminal (+) and an output terminal. A voltage of a sum of the toggle signal TS and the DC voltage VCST may be input to the non-inversion input terminal (+). A signal output from the operational amplifier may be fed back to the inversion input terminal (−), and thus the operational amplifier buffers and compensates the toggle signal TS and the DC voltage VCST to output a toggle voltage VCST1. For example, the toggle voltage VCST1 is more than 6.5V and less than 9.5V. The toggle voltage VCST1 may vary periodically.

Figure 6:
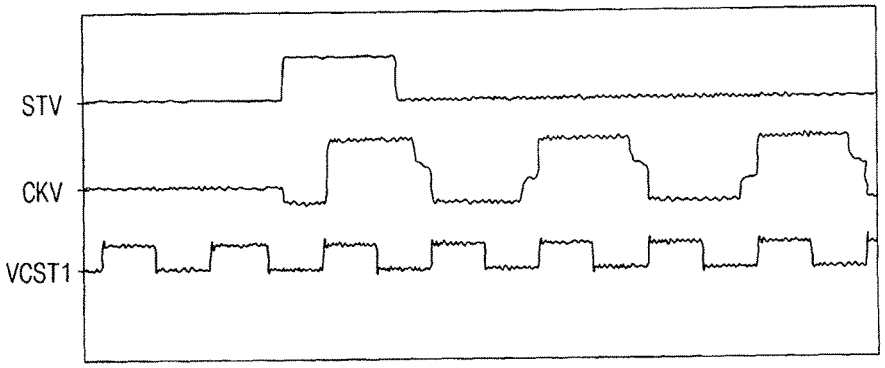
FIG. 6 is a waveform diagram illustrating a toggle voltage according to an exemplary embodiment of the present inventive concept.

FIG. 6 is a waveform diagram illustrating a toggle voltage according to an exemplary embodiment of the present inventive concept.

Referring to FIG. 6, a waveform diagram of a vertical start signal STV, a clock signal CKV and a toggle voltage VCST1 is illustrated.

The toggle voltage input circuit 50 is driven by the vertical start signal STV and the clock signal CKV to output the toggle voltage VCST1. The toggle voltage VCST1 may be more than 6.5V and less than 9.5V. The toggle voltage VCST1 may vary periodically. For example, the toggle voltage input circuit 50 outputs a pattern alternating between a voltage of 6.5V for a predetermined time and a voltage of 9.5V for a predetermined time. The toggle voltage input circuit 50 may repeat the pattern.

Figure 7:
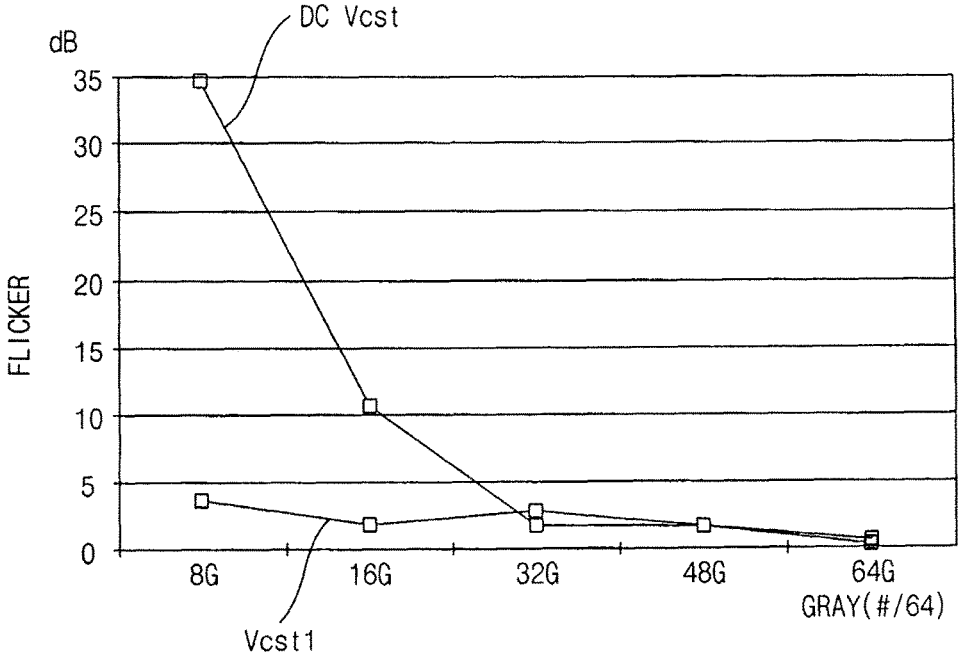
FIG. 7 is a graph illustrating a flicker of a toggle voltage according to an exemplary embodiment of the present inventive concept.

FIG. 7 is a graph illustrating a flicker of a toggle voltage according to an exemplary embodiment of the present inventive concept.

Referring to FIG. 7, a flicker value at different levels of a grayscale value is illustrated.

When the DC voltage VCST is input to the auxiliary switching element RD TFT, and when a grayscale value is 8 G, a flicker value is 35 dB. In addition, when the DC voltage VCST is input to the auxiliary switching element RD TFT, and when a grayscale value is 64 G, a flicker value is 0 dB.

When a toggle voltage VCST1 is input to the auxiliary switching element RD TFT, and when a grayscale value is 8 G, a flicker value is 4 dB. In addition, when the toggle voltage VCST1 is input to the auxiliary switching element RD TFT, and when a grayscale value is 64 G, a flicker value is 0 dB.

For example, when the DC voltage VCST is input to the auxiliary switching element RD TFT, a flicker value according to a grayscale value may be high. However, when the toggle voltage VCST1 is input to the auxiliary switching element RD TFT, a flicker value according to a grayscale value may be low.

A pixel of a display apparatus according to an exemplary embodiment of the present inventive concept includes two sub-pixels. The pixel may include a high sub-pixel H-pixel and a low sub-pixel L-pixel. Hereinafter, a ratio of a voltage applied to the high sub-pixel H-pixel with reference to a voltage applied to the low sub-pixel L-pixel is referred to as a voltage ratio. In addition, a difference between a voltage applied to the high sub-pixel H-pixel and a voltage applied to the low sub-pixel L-pixel is referred to as a difference level.

A voltage ratio and a difference level according to a storage voltage are illustrated in Table 1.

TABLE 1

| | 4 V | 6 V | 8 V | 10 V |
|---|---|---|---|---|
| voltage ratio | 0.72 | 0.71 | 0.68 | 0.72 |
| difference level (V) | 3.0 | 2.3 | 1.6 | 1.0 |

Referring to Table 1, when a storage voltage Vcst is 8V, a voltage ratio may be minimized. In addition, when a storage voltage Vcst is 10V, a difference level may be minimized. When a difference level is increased, DC residual may occur due to a difference between a voltage of a high sub-pixel H-pixel and a voltage of a low sub-pixel L-pixel. A high difference level may result in an afterimage.

When a storage voltage Vcst is high, a difference level may be minimized. However, when a storage voltage Vcst is high, a kickback value may be increased. In an exemplary embodiment of the present inventive concept, a storage voltage capable of varying periodically may be applied to the storage electrode of a low sub-pixel. This way, the kickback value may not be so high.

For example, a display apparatus according to an exemplary embodiment of the present inventive concept applies a toggle voltage that is periodically varied to a low sub-pixel. The toggle voltage may be more than 6.5V and less than 9.5V. Applying the toggle voltage to the low sub-pixel may reduce flicker and the occurrence of an afterimage on the display device.

Figure 8:
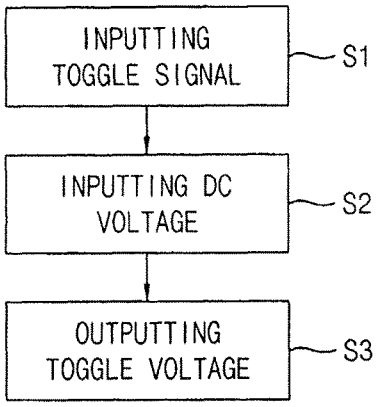
FIG. 8 is a block diagram illustrating a pixel of a method of driving a display apparatus according to an exemplary embodiment of the present inventive concept.

FIG. 8 is a block diagram illustrating a method of driving a pixel of a display apparatus according to an exemplary embodiment of the present inventive concept.

Referring to FIGS. 4 and 8, a method of driving a display apparatus according to an exemplary embodiment of the present inventive concept includes inputting a toggle signal S1 and a DC voltage S2 into a toggle voltage input circuit and outputting a toggle voltage S3.

According to an exemplary embodiment of the present inventive concept, the amplifier 30 receives a toggle signal TS from the toggle signal input circuit 10 (S1). The toggle signal input circuit 10 may include a transistor. The toggle signal TS may include a voltage of more than 3.0V and less than 3.5V. For example, the toggle signal TS may be a voltage of 3.3V.

The amplifier 30 receives the DC voltage VCST from the DC voltage input circuit 20 (S2). The DC voltage input circuit 20 includes a diode. For example, the DC voltage VCST may be a voltage of 6.5V.

The amplifier 30 amplifies the toggle signal TS and the DC voltage VCST to output a toggle voltage VCST1 (S3).

The amplifier 30 includes an operational amplifier. The operational amplifier buffers and compensates the toggle signal TS and the DC voltage VCST to output a toggle voltage VCST1. The operational amplifier includes an inversion input terminal (−), a non-inversion input terminal (+) and an output terminal. A voltage of a sum of the toggle signal TS and the DC voltage VCST is input to the non-inversion input terminal (+). A negative feedback loop is formed when the signal output from the operational amplifier is fed back to the inversion input terminal (−). The operational amplifier buffers and compensates the toggle signal TS and the DC voltage VCST to output a toggle voltage VCST1. For example, the toggle voltage VCST1 may be more than 6.5V and less than 9.5V. The toggle voltage VCST1 may vary periodically.

According to an exemplary embodiment of the present inventive concept, a display apparatus applies a toggle voltage capable of being varied periodically to a low sub-pixel. The toggle voltage may be more than 6.5V and less than 9.5V. The toggle voltage is applied to the low sub-pixel, and thus a flicker may be decreased and a likelihood of an afterimage may be reduced.

While the present inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display apparatus, comprising:

a display panel, wherein the display panel comprises:

a first sub-pixel comprising a first switching element connected to a gate line extending in a first direction and a data line extending in a second direction crossing with the first direction; and a second sub-pixel comprising a second switching element connected to the gate line and the data line, and a third switching element connected to the second switching element and a storage line, a toggle voltage input circuit connected to the storage line to apply a toggle voltage to the second sub-pixel, wherein a level of the toggle voltage varies periodically, wherein the toggle voltage input circuit comprises:

a toggle signal input circuit configured to output a toggle signal;

a direct current (DC) voltage input circuit configured to output a DC voltage; and an amplifier configured to output the toggle voltage by amplifying voltage based on the toggle signal and the DC voltage, wherein the toggle voltage is fed back to an input of the amplifier.

2. The display apparatus of claim 1, wherein the toggle voltage is more than 6.5V and less than 9.5V.

3. The display apparatus of claim 1, wherein the toggle signal input circuit comprises a transistor, and wherein the toggle signal is more than 3.0V and less than 3.5V.

4. The display apparatus of claim 1, wherein the DC voltage input circuit comprises a diode, and wherein the DC voltage is 6.5V.

5. The display apparatus of claim 1, wherein the amplifier comprises an operational amplifier.

6. The display apparatus of claim 1, wherein the first sub-pixel comprises a first pixel electrode, and a first voltage is applied to the first pixel electrode, and the second sub-pixel comprises a second pixel electrode, and a second voltage less than the first voltage is applied to the second pixel electrode.

7. The display apparatus of claim 1, wherein a voltage applied to the second sub-pixel is distributed to the second switching element and the third switching element.

8. The display apparatus of claim 1, further comprising:

a data driver connected to the data line to apply a data voltage to the display panel.

9. The display apparatus of claim 1, further comprising:

a gate driver connected to the gate line to apply a gate voltage to the display panel.

10. A method of driving a display panel, the method comprising:

inputting a toggle signal to an amplifier;

inputting a direct current (DC) voltage to the amplifier; and outputting a toggle voltage from the amplifier, wherein the toggle voltage is based on the toggle signal and the DC voltage, and wherein the toggle voltage is periodically varied, wherein the display panel comprises a first sub-pixel including a first switching element connected to a gate line extending in a first direction and a data line extending in a second direction crossing with the first direction, and a second sub-pixel comprising a second switching element connected to the gate line and the data line, and a third switching element connected to the second switching element and a storage line, wherein the amplifier is included in a toggle voltage input circuit, the toggle voltage input circuit further comprising:

a toggle signal input circuit configured to generate the toggle signal; and a DC voltage input circuit configure to generate the DC voltage, wherein the toggle signal input circuit comprises a transistor, and wherein the toggle signal is more than 3.0V and less than 3.5V.

11. The method of claim 10, wherein the toggle voltage is more than 6.5V and less than 9.5V.

12. The method of claim 10, wherein the amplifier comprises an operational amplifier.

13. The method of claim 10, wherein the first sub-pixel further comprises:

a first pixel electrode that is applied with a first voltage; and the second sub-pixel further comprises a second pixel electrode that is applied with a second voltage less than the first voltage.

14. The method of claim 10, further comprising:

distributing a voltage applied to the second sub-pixel to the second switching element and the third switching element.

15. The method of claim 10, wherein the display panel is connected to a data driver, wherein the data driver is connected to the data line to apply a data voltage to the display panel.

16. The method of claim 10, wherein the display panel is connected to a gate driver, wherein the gate driver is connected to the gate line to apply a gate voltage to the display panel.

17. A method of driving a display panel, the method comprising:

inputting a toggle signal to an amplifier;

inputting a direct current (DC) voltage to the amplifier; and outputting a toggle voltage from the amplifier, wherein the toggle voltage is based on the toggle signal and the DC voltage, and wherein the toggle voltage is periodically varied, wherein the display panel comprises a first sub-pixel including a first switching element connected to a gate line extending in a first direction and a data line extending in a second direction crossing with the first direction, and a second sub-pixel comprising a second switching element connected to the gate line and the data line, and a third switching element connected to the second switching element and a storage line, wherein the amplifier is included in a toggle voltage input circuit, the toggle voltage input circuit further comprising:

a toggle signal input circuit configured to generate the toggle signal; and a DC voltage input circuit configured to generate the DC voltage, wherein the DC voltage input circuit comprises a diode, and wherein the DC voltage is 6.5V.

* * * * *